US008165480B2

(12) United States Patent
Hamaya et al.

(10) Patent No.: US 8,165,480 B2
(45) Date of Patent: Apr. 24, 2012

(54) IMAGE FORMING APPARATUS WITH IMAGE CARRIER DETERIORATION DETECTION

(75) Inventors: Masahito Hamaya, Nagoya (JP); Hiroyuki Naganawa, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1035 days.

(21) Appl. No.: 12/108,954

(22) Filed: Apr. 24, 2008

(65) Prior Publication Data

US 2008/0267640 A1 Oct. 30, 2008

(30) Foreign Application Priority Data

Apr. 25, 2007 (JP) ..... 2007-116105

(51) Int. Cl.
*G03G 15/00* (2006.01)

(52) U.S. Cl. ..... 399/24; 399/26

(58) Field of Classification Search ..... 399/26, 399/24

See application file for complete search history.

(56) References Cited

FOREIGN PATENT DOCUMENTS

| | | |
|---|---|---|
| JP | 2001-194850 | 7/2001 |
| JP | 2001-265177 | 9/2001 |
| JP | 2002-091100 | 3/2002 |
| JP | 2004-020659 | 1/2004 |
| JP | 2007-034087 | 2/2007 |

OTHER PUBLICATIONS

Notice of Reasons for Refusal in Japanese Application No. 2007-116150, Mailed May 26, 2009.

*Primary Examiner* — David Gray
*Assistant Examiner* — Laura Roth
(74) *Attorney, Agent, or Firm* — Banner & Witcoff, Ltd.

(57) ABSTRACT

An image forming apparatus, according to the present invention can include, an image carrier, a charger configured to charge the image carrier, an exposure unit configured to form an electrostatic latent image by exposing the image carrier, a developing unit configured to develop the electrostatic latent image, a detection unit configured to detect the density of a developer adherent to the image carrier, and a controller configured to determine a deteriorated state of the image carrier, by charging the image carrier and then conducting a development, in a condition where a potential difference between the charger and the developing unit is set to be smaller than that at the time of image formation, before detecting a density of a developer on an unirradiated portion on the image carrier, so that a detection result to be used for its decision of the deteriorated state of the image carrier is obtained.

9 Claims, 9 Drawing Sheets

IMAGE FORMING APPARATUS WITH IMAGE CARRIER DETERIORATION DETECTION

CROSS REFERENCE TO RELATED APPLICATION

This application claims priority from Japanese Patent Application No. 2007-116105 filed Apr. 25, 2007. The entire content of this priority application is incorporated herein by reference.

TECHNICAL FIELD

The disclosure relates to an electrophotographic image forming apparatus.

BACKGROUND

In an electrophotographic image forming apparatus, the surface of a photoconductor (image carrier) is uniformly charged by a charger and exposed by a exposing device, so as to form an electrostatic latent image. The electrostatic latent image is then developed by a developing device to form a toner image (developer image), which is then transferred onto such as a paper sheet. In this configuration, the surface of the photoconductor becomes deteriorated by gradual wear-out or by adhesion of foreign matter, causing deterioration of the image quality. To deal with this, technologies for detecting a deteriorated state of the surface of a photoconductor have been developed.

One such technology, a plurality of toner adhesion patterns formed on the surface of a photoconductor in different image forming conditions, and in each of these patterns, the optical density value of a toner-adhered part as well as the background part are measured in order to calculate the ratio therebetween. After that, when the gap of the above ratio is greater than a prescribed value due to the difference of the image forming condition in each of the patterns, the deterioration of the surface of the photoconductor is determined, and an user is informed thereof so that the replacement of the photoconductor is encouraged.

However, in the above technology, a large amount of toner is consumed for detecting a deteriorated state, since a plurality of toner adhesion patterns are formed on the surface of a photoconductor. In the view of the above described circumstance, there is need for a technology that enables both the detection of deterioration of an image carrier and the reduction of the developer consumption.

SUMMARY

An image forming apparatus, according to the present invention can include, an image carrier configured to support an electrostatic latent image, a charger configured to charge the image carrier to an electrical potential according to an applied voltage, an exposure unit configured to form an electrostatic latent image by exposing the image carrier, a developing unit configured to develop the electrostatic latent image by adhering a developer to the image carrier, a detection unit configured to detect the density of a developer adherent to the image carrier, and a controller configured to determine a deteriorated state of the image carrier, by charging the image carrier and then conducting a development with the developing unit, in a condition where a potential difference between the charger and the developing unit is set to be smaller than that at the time of image formation, before detecting a density of a developer on a portion on the image carrier with the detection unit, so that a detection result to be used for its decision of the deteriorated state of the image carrier is obtained, wherein the portion of the image carrier is a portion which is charged and thereafter subjected to the development by use of the developing unit without being subjected to exposure by the exposure unit in the condition where a potential difference between the charger and the developing unit is set to be smaller than that at the time of image formation.

BRIEF DESCRIPTION OF THE DRAWINGS

Illustrative aspects in accordance with the invention will be described in detail with reference to the following figures wherein.

DETAILED DESCRIPTION

With embodiments of the present invention described hereinafter with reference to the accompanying drawings, it is to be understood that the invention is not limited to those precise embodiments, and that various changes and modifications may be effected therein by one skilled in the art without departing from the scope or spirit of the invention as defined in the appended claims.

One aspect of the present invention is explained with reference to FIGS. 1 to 5.

(General Configuration of the Printer)

Figure 1:
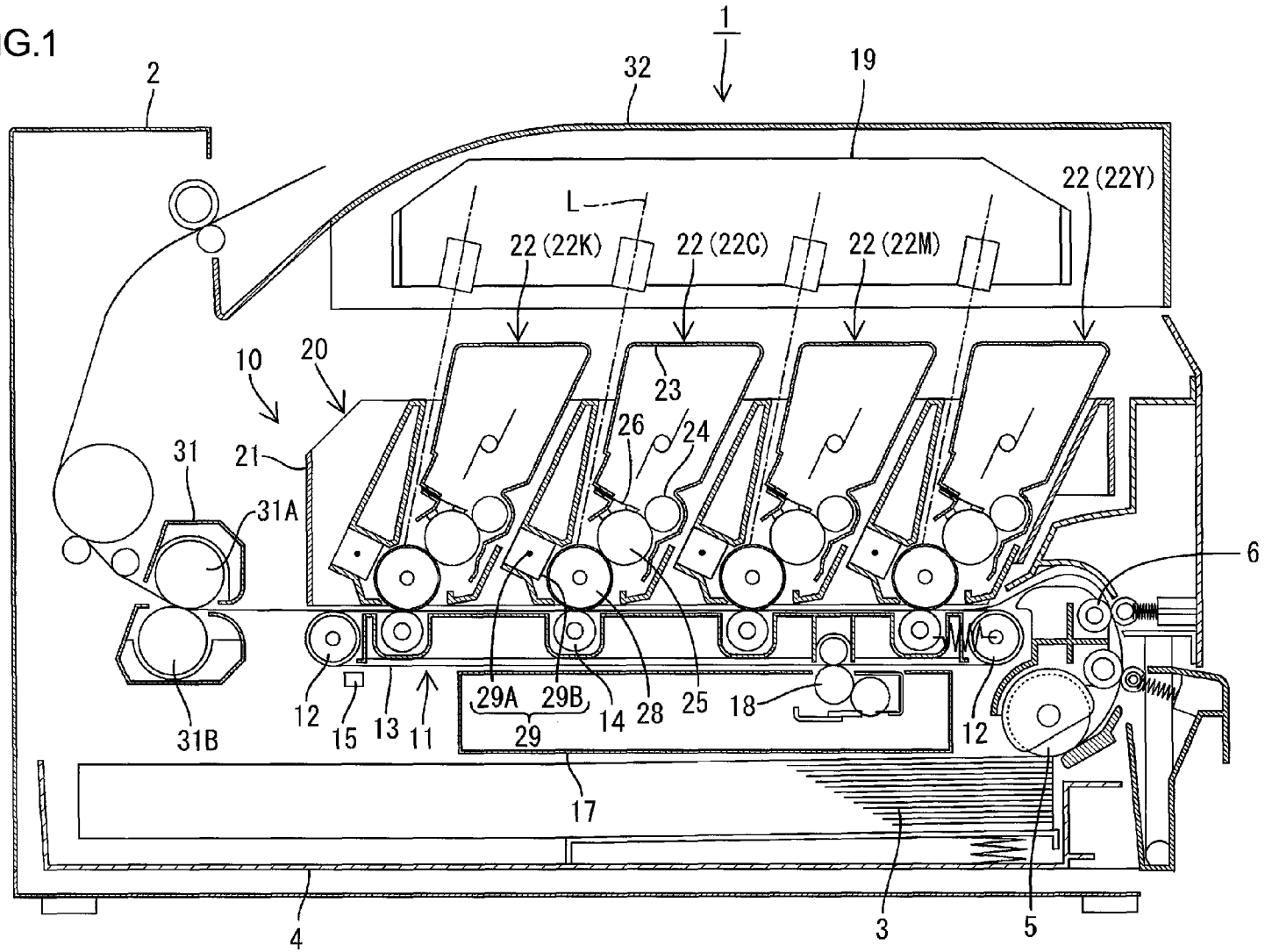
FIG. 1 is a cross-sectional side view showing a general configuration of a printer according to one aspect of this invention.

FIG. 1 is a cross-sectional side view showing a general configuration of a printer 1, which is an example of an image forming apparatus according to the present invention. Additionally, in the following description, the right side of FIG. 1 is the front.

The printer 1 comprises a main body casing 2, and in the bottom thereof a feed tray 4, in which a recording medium 3 (such as a paper sheet, a plastic sheet, or the like) is stacked. A feed roller 5 is near the front edge of the feed tray 4, and with the rotation thereof, a recording medium 3 is transferred to a registration roller 6. The registration roller 6 is capable of determining a skew correction of the recording medium 3 before delivering the recording medium 3 onto a belt unit 11 in an image forming unit 10.

The image forming unit 10 comprises the belt unit 11, a scanning unit 19, a processing unit 20, a fixing unit 31, and so on.

The belt unit 11 is configured to have a belt 13 (one example of a transfer member), which can be made of a polycarbonate that extends between a pair of belt supporting rollers 12. With the rotational drive of the rear belt supporting roller 12, the belt 13 moves in the counterclockwise direction in the present figure, so that the recording medium 3 on the upper surface of the belt 13 is delivered to the rear side. Also, on the inside of the belt 13, a transferring roller 14 is disposed inside belt 13 in a position opposed to each the photosensitive drum 28 in the later-described processing unit 20.

Furthermore, a sensor 15 (one example of a detection unit) for detecting test patterns formed on the belt 13 is provided in a position opposed to the bottom surface of the belt 13. The sensor 15 exposes a light on the surface of the belt 13, and receives the reflected light with such as a phototransistor, and then outputs a signal corresponding to the amount of the received light. Further, a belt cleaner 17 is provided under the belt unit 11 for cleaning the belt 13. The belt cleaner 17, which contact with the surface of the belt 13, electrically vacuums up the paper powder or the toner adhered to the surface of the belt 13 with a cleaning roller 18.

The scanning unit 19 (one example of the exposure unit) exposes a laser L, that has been emitted from a laser emitting unit (not shown), onto the surface of the photosensitive drum 28 corresponding to a color.

The processing unit 20 includes a frame 21, which can be drawn out from the main body casing 2, and developing cartridges 22 (22Y, 22M, 22C, and 22K) removable from the frame 21 and respectively corresponding to, for example, four colors (Yellow, Magenta, Cyan, and Black). In addition, the photosensitive drum 28 and the charger 29 corresponding to the each developing cartridge 22 are provided in the bottom of the frame 21.

Each of the developing cartridges 22 is provided with a toner storing chamber 23 for storing the toner, as a developer, of each color (one example of a coloring agent) in the upper part of the inside of its box casing, and below the chamber 23, there are provided a toner feed roller 24, developing roller 25, and a thickness regulating blade 26. Each of the toner storing chambers 23 stores the non-magnetic one-component polymerized toner of a positive charge type of each color as a developer.

The feed roller 24 can be composed of a metallic roller shaft covered with a conductive foam material, and the developing roller 25 (one example of a developing unit) can be composed of a metallic roller shaft covered with a conductive rubber. The toner released from the toner storing chamber 23 is fed to the developing roller 25 by rotation of the feed roller 24, thereby being positively and triboelectrically-charged in between the feed roller 24 and the developing roller 25. In addition, the toner fed onto the developing roller 25 then proceeds into the gap between the thickness regulating blade 26 and the developing roller 25 along with the rotation of the developing roller 25, and is sufficiently triboelectrically-charged there, so as to be supported on the developing roller 25 as a thin-layer having a certain thickness.

The photosensitive drum 28 (one example of an image carrier) can comprise a grounded metallic drum body, which is covered on its surface with a photosensitive layer of a positive charge type that is made of a polycarbonate-based material.

The charger 29, for example, of a scorotron type, comprises a discharge wire 29A and a grid 29B. The discharge wire 29A is disposed in a position opposed to the photosensitive drum 28 with a prescribed interval in between. The grid 29B, for controlling the amount of electrical discharge from the discharge wire 29A to the photosensitive drum 28, is disposed between the discharge wire 29A and the photosensitive drum 28. The charger 29 applies a high-voltage to the discharge wire 29A resulting in a corona discharge, while maintaining the electrical current emitted from the discharge wire 29A to the grid 29B at a constant value (more specifically, maintaining the grid voltage at a constant value), thus the surface of the photosensitive drum 28 can be uniformly and positively charged.

At the time of image formation, the photosensitive drum 28 is rotationally driven in the clockwise direction in the present figure, intended to provide a uniform and positive charge onto its surface via the charger 29. And then, the positively-charged part is exposed to a laser that is emitted from the scanning unit 19 for high-speed scanning. Thereby, the positive charge on the laser-irradiated portion of the photosensitive layer is eliminated in response to the laser, and consequently an electrostatic latent image corresponding to the image to be formed on the recording medium 3 is formed on the surface of the photosensitive drum 28. Hereinafter, a portion on the photosensitive drum 28, at which the laser is actually radiated after charging, is referred to as "an irradiated portion", while a portion at which the laser is not radiated is referred to as "an unirradiated portion".

Next, with the rotation of the developing roller 25, the toner, positively-charged and supported on the developing roller 25, is supplied to the electrostatic latent image being formed on the surface of the photosensitive drum 28 when it comes to a position opposed to, and contacts with, the photosensitive drum 28. This results in the visualization of the electrostatic latent image on the photosensitive drum 28, and supports a toner image with the toner adhered only to the exposed part on the surface of the photosensitive drum 28.

After that, while the recording medium being delivered on the belt 13 is passing through each of the transfer positions in between the photosensitive drum 28 and the transferring roller 14, the toner image supported on the surface of each of the photosensitive drums 28 is sequentially transferred to the recording medium 3 by means of the negative transferring voltage applied to the transferring roller 14. The toner image which has been thus transferred onto the recording medium 3 is then delivered to the fixing unit 31.

The fixing unit 31 can include a heating roller 31A having a heat source, and a pressing roller 31B for pressing the recording medium 3 toward the side of the heating roller 31, and heat-fixes the toner image that has been transferred onto the recording medium 3. The recording medium 3 heat-fixed by the fixing unit 31 is then delivered toward the upper side, and discharged onto the catch tray 32 provided on the top surface of the main body casing 2.

(Electrical Configuration of the Printer)

Figure 2:
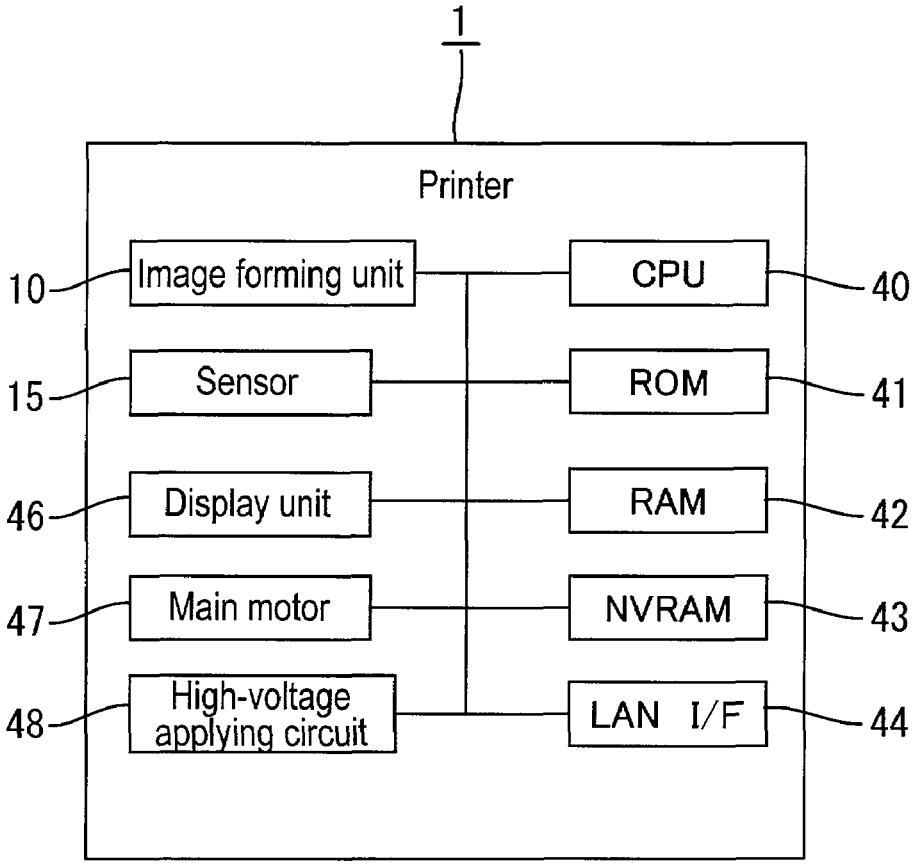
FIG. 2 is a block diagram schematically showing an electrical configuration of a printer.

FIG. 2 is a block diagram schematically showing an electrical configuration of the printer 1. The printer 1 includes a CPU 40 (one example of a controller and a correction unit), a ROM 41, a RAM 42, a NVRAM (nonvolatile memory) 43, a network interface 44, a display unit 46, a main motor 47, and a high-voltage applying circuit 48, the image forming unit 10 and the sensor 15 being connected thereto.

Stored in the ROM 41 are programs for conducting various operations of the printer 1, such as the later-described deterioration detection processing of a photosensitive drum. In accordance with these programs read from the ROM 41, the CPU 40 can perform various operations while recording the processing results into the RAM 42 or the NVRAM 43. The network interface 44 can be connected to an external computer via a communication line (not shown), thereby enabling the interactive data communication.

The display unit 46 can include a liquid crystal display and lamps, and be capable of displaying various setting screens and operational states.

The main motor 47 allows operation of the registration roller 6, the belt supporting roller 12, the transferring rollers 14, the developing rollers 25, the photosensitive drums 28, and the heating roller 31A.

The high-voltage applying circuit 48 can provide a developing voltage to the developing roller 25, a transferring voltage to the transferring roller 14, a charging voltage to the discharge wire 29A in the charger 29, and a grid voltage to the grid 29B.

(Calibration Processing)

In the printer 1, at the time of applying the power source or performing the printing of a prescribed number of paper sheets, the calibration processing is conducted by the control of the CPU 40 for calibrating the image formation property of the image forming unit 10. This calibration processing includes, for example, two kinds of corrections: color smear correction and density correction. In the color smear correction, a test pattern for each color is printed on the surface of the belt 13 by the scanning unit 19 and the processing unit 20, and the position of said test pattern is measured by the sensor 15, so that a smear amount of the transfer position of each color is calculated. Based on the smear amount, a correction of timing for exposure by the scanning unit 17 (in short, the exposure position relative to the photosensitive drum 28) is performed. Additionally, in the density correction, a test pattern (density patch) for each color is printed on the surface of the belt 13 by the scanning unit 19 and the processing unit 20 in order to measure the density of the pattern by the sensor 15. Based on the measured result, the density for image formation is calibrated.

(Deterioration Detection Processing of the Photosensitive Drum)

Figure 3:
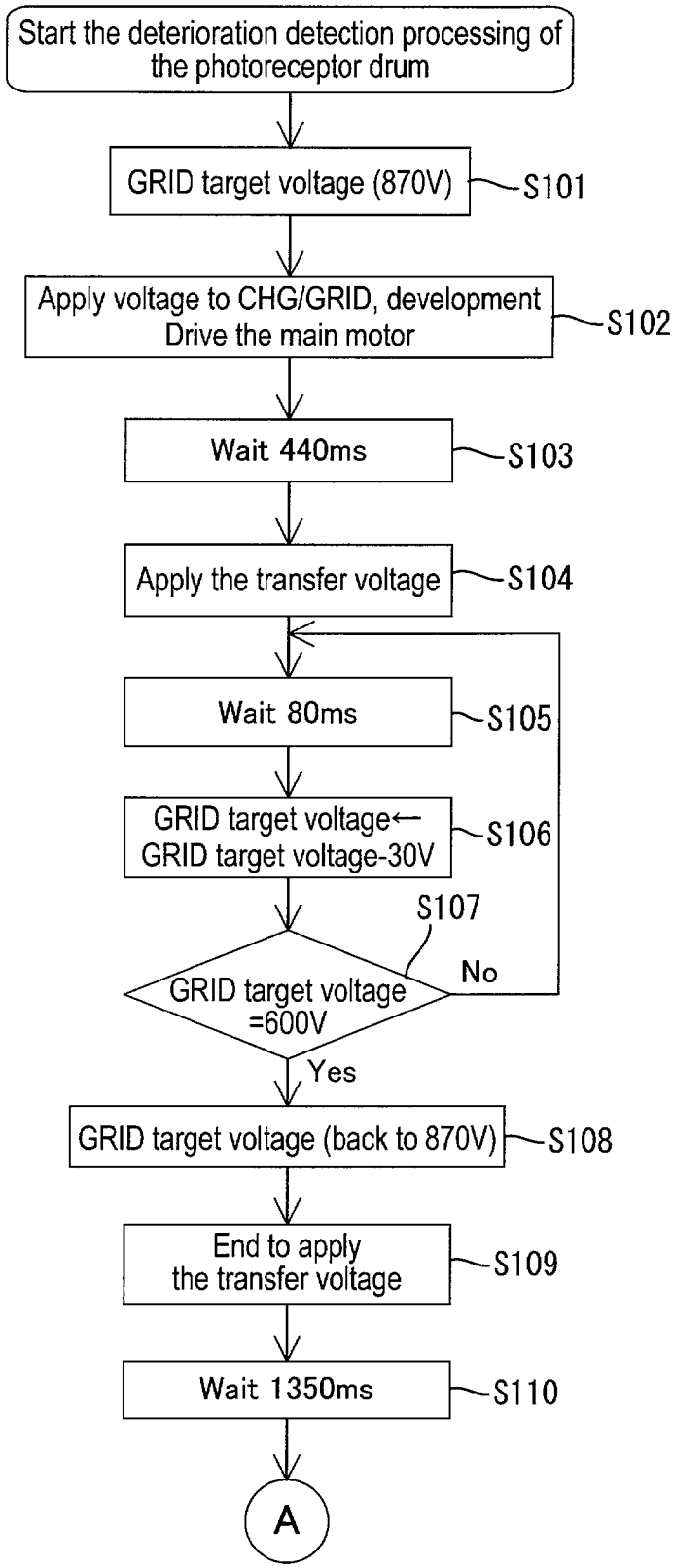
FIG. 3 is a flowchart showing a processing flow of the deterioration detection of a photosensitive drum.
Figure 4:
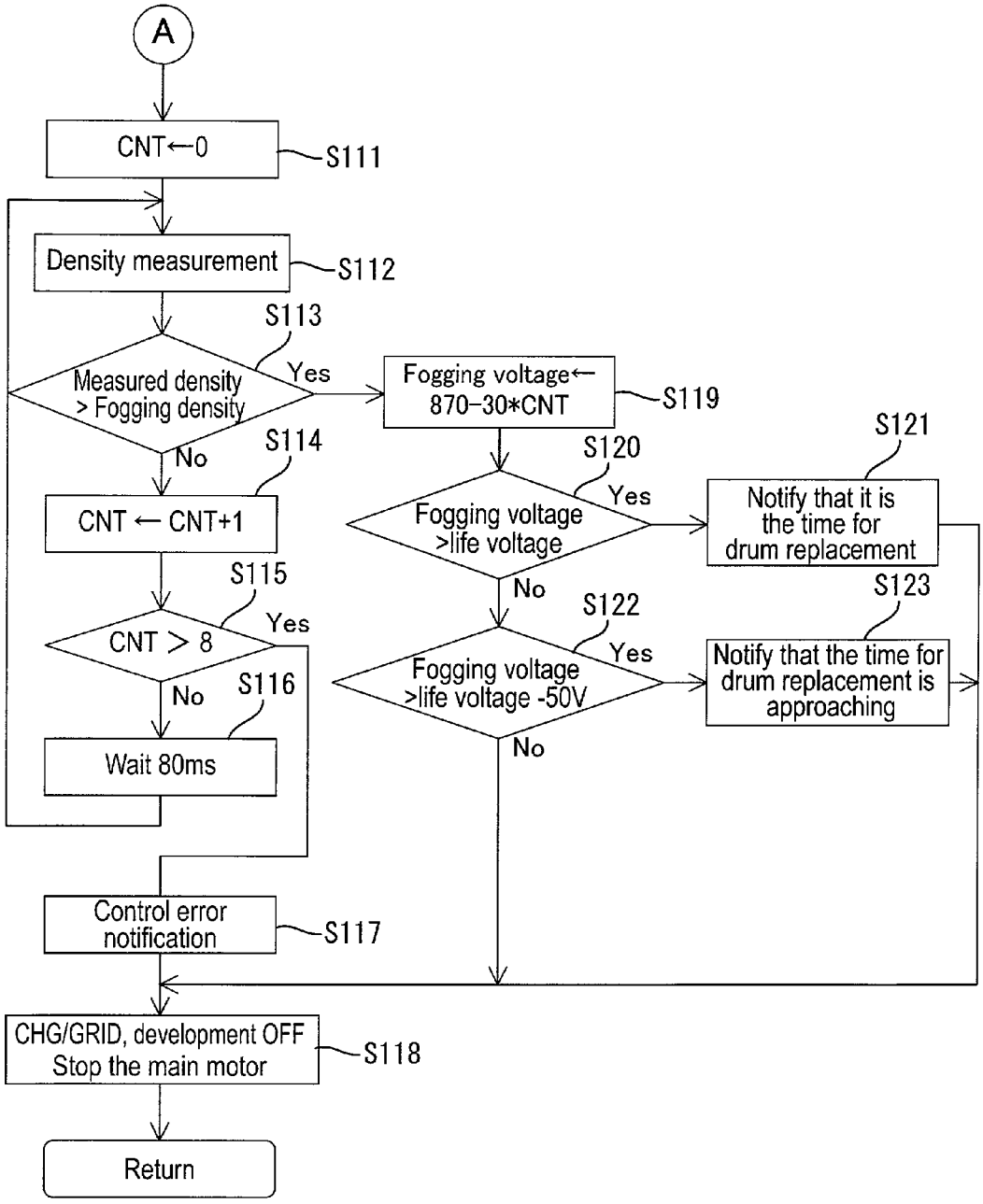
FIG. 4 is a flowchart showing a processing flow of the deterioration detection of a photosensitive drum.
Figure 5:
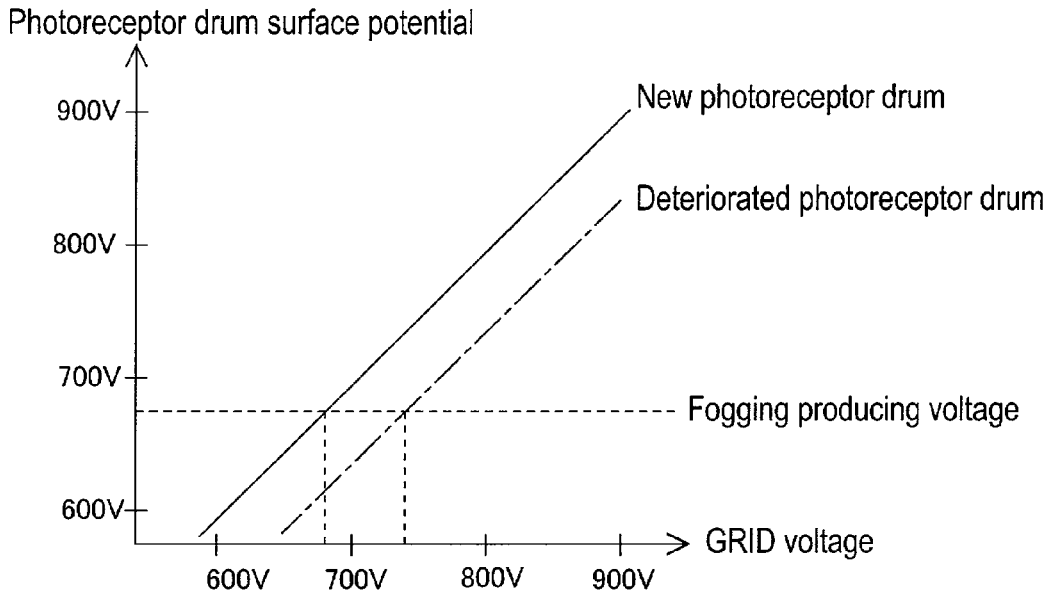
FIG. 5 is a graph showing a relationship between a voltage of a grid and a surface potential of a photosensitive drum.

Deterioration detection processing of the photosensitive drum 28, controlled by the CPU 40, will now be described. FIGS. 3 and 4 are flowcharts each showing the processing flow of the deterioration detection processing. FIG. 5 is a graph showing a relationship between a voltage of the grid and a surface potential of the photosensitive drum.

This deterioration detection processing is conducted for every photosensitive drum 28 at the time of, such as, applying the power source or performing the printing of a certain number of paper sheets. First, a target voltage is set as a control target of the voltage applied to the grid 29B in the charger 29 (grid voltage) (S101). This can be set at 870V, which is the same as or lower than the grid voltage for normal image formation. Next, the CPU 40 allows the application of a voltage to the discharge wire 29A, the grid 29B, and the developing roller 25 via the high-voltage applying circuit 48, and starts the drive of the main motor 47 (S102).

Thereby, a voltage according to the target voltage is applied to the grid 29B in the charger 29 while a voltage (around 6.5 to 8.5 kV) is applied to the discharge wire 29A, resulting in a corona discharge. Then, the surface of the photosensitive drum 28 is charged uniformly and positively, while the photosensitive drum 28 rotates. Specifically, a part of the surface of the photosensitive drum 28, which can be opposed to the charger 29 during the rotation, is uniformly and positively charged. Thereafter, the developing roller 25 rotates while a steady voltage of 400V is applied thereto, so that the positively charged toner is supported on its surface. Note that exposure by use of the scanning unit 19 is skipped during deterioration detection processing. Therefore, a part of the photosensitive drum 28 charged by the charger 29 can wholly remain positively charged. That is, "an irradiated portion" is not formed on the photosensitive drum 28 during the deterioration detection processing, and therefore the entire of the part positively charged by the charger 29 corresponds to "an unirradiated portion".

Here, as shown in FIG. 5, the electrical potential of the part (charged by the charger 29) on the surface of the photosensitive drum 28, becomes the value according to the voltage applied to the grid 29B (the applied voltage of the charger). And also, even if the voltage applied to the grid 29B is the same value, the surface potential of the charged part in a deteriorated photosensitive drum 28 becomes less than that in a new photosensitive drum 28. In a new photosensitive drum 28, the surface potential can be at a level slightly lower than 870V when the voltage of the grid 29B is 870V. When the part having the above potential comes to the position opposed to the developing roller 25 of 400V, the fogging, in which the toner on the developing roller 25 adheres to the photosensitive drum 28, does not normally occur. As shown in FIG. 5, when the potential is the fogging producing potential, at which the fogging occurs when reducing the surface potential of the photosensitive drum 28 (more specifically, lowering the voltage applied to the grid 29B), the surface potential in a deteriorated photosensitive drum 28 reaches said fogging producing potential at the higher voltage of the grid 29B as compared with the one in a new photosensitive drum 28.

In this example, the CPU 40 waits for 440 ms after starting the drive of the main motor 47 in S102 (S103). Here, one rotation of the photosensitive drum 28 needs 640 ms, including 440 ms in which the part charged by the charger 29 on the photosensitive drum 28 reaches a position opposed to the transferring roller 14, surpassing the position opposed to the developing roller 25. The CPU 40 then applies the transfer voltage (around 500V to 7 kV) to the transferring roller 14 by means of the high-voltage applying circuit 48 (S104). This enables the toner to be transferred to the surface of the belt 13, if the toner has been adhered to the part in the surface of the photosensitive drum 28, which is in a position opposed to the transferring roller 14.

Next, the CPU 40 waits for 80 ms (corresponding to one-eighth rotation of the photosensitive drum 28) (S105), before reducing the target voltage of the grid 29B for 30V (S106). When the target voltage of the grid 29B does not reach 600V (S106: No), the processing returns to S105 in order to repeat the same steps. When the target voltage of the grid 29B reaches 600V (S107: Yes), the target voltage is set back to 870V (S108). By setting back the target voltage to 870V, the fogging is suppressed, thereby reducing the toner consumption. This lowers the grid voltage gradually like 840, 810, 780, . . . and 630V in eight stages, and along with this voltage drop, the surface potential of the photosensitive drum 28 drops in stages at every one-eighth rotation. The part, in which the surface potential is lowered in eight stages (for one rotation of the drum), is the part to be measured later for the amount of toner adhesion, in other words the density of the toner.

The CPU 40 then ends the application of the transfer voltage from the high-voltage applying circuit 48's (S109), and waits for 1350 ms (S110). In this 1350 ms, the part to be measured first in the surface of the photosensitive drum 28 (the part corresponding to the grid voltage 840V) comes to a position opposed to the belt 13 (the transferring roller 14), and a virtual toner-adhered part on the belt 13 (the part to which the toner is transferred when the toner has been adhered to the photosensitive drum 28) comes to a position of the sensor 15 by means of the rotation of the belt 13. This waiting time varies in accordance with the arrangement position of the photosensitive drum 28.

Next, the CPU 40 sets the value of a counter CNT to zero (S111), and measures the density of the toner adhered to the belt 13 with the sensor 15 (S112). After that, the toner density value obtained by the measurement is compared with the fogging density value, which is predetermined as a reference for distinguishing the occurrence of fogging (S113). When the measured toner density value is not greater than the fogging density value (S113: No), more specifically, when no occurrence of the fogging is distinguished, the counter CNT is incremented by one (S114). When the value of the counter CNT does not surpass eight (S115: No), the CPU 40 waits for 80 ms and then returns to S112, before measuring a virtual toner-adhered part in the next stage (corresponding to the part in the photosensitive drum 28 having the one stage lower surface potential).

As described above, when the measured toner density value does not surpass the fogging density value, S 112 to S116 are repeated, so that the virtual toner-adhered part in each stage is measured. On the other hand, when the counter CNT indicates a number greater than eight (S115: Yes), more specifically, no occurrence of fogging in each of the virtual toner-adhered parts in eight stages is distinguished, there may possibly be an irregularity, and a notification showing the control error is displayed on the display unit 46 (S117). After that, the voltage application from the high-voltage applying circuit 48 to the discharge wire 29A, the grid 29B, and the developing roller 25 is turned off, and the drive of the main motor 47 is stopped (S118), so that the deterioration detection processing is ended.

In S113, when the measured toner density is greater than the fogging density value (S113: Yes), the grid voltage (of one stage higher than the grid voltage at the time of charging the part on the photosensitive drum 28 corresponding to the virtual toner-adhered part, where the toner density has been measured), is calculated by the formula [870–30*CNT]. The result is the fogging voltage (S119).

The CPU 40 then compares the fogging voltage value with a predetermined life voltage value (for example, 680V) (S120), and if the fogging voltage value is greater than the life voltage value (S120: Yes), the display unit 46 shows a notification instructing that it is the time for replacement of the photosensitive drum 28 (S121). And also, when the fogging voltage is less than the life voltage (S120: No), and furthermore, is greater than the value deducting fifty from the life voltage (S122: Yes), the CPU 40 sends a signal to the display unit 46 resulting in a notification that the time for replacement of the photosensitive drum 28 is approaching (S123).

When the fogging voltage is not greater than the value deducting fifty from the life voltage (S122: No), or when S121 and S123 have been performed for the notification, the voltage application from the high-voltage applying circuit 48 to the discharge wire 29A, the grid 29B, and the developing roller 25 is turned off, and the drive of the main motor 47 is stopped (in S118), so that the deterioration detection processing is ended.

As described in the above, according to the present aspect, the photosensitive drum 28 is charged and thereafter subjected to the development by use of the developing roller 25, in a condition in which the potential difference between the grid voltage and the developing voltage is set to be less than that at the time of image formation. Then, the density of toner adherent to the unirradiated portion on the photosensitive drum 28 is detected. When the photosensitive drum 28 is deteriorated, toner adhesion to the unirradiated portion (i.e., the fogging) may occur. Therefore, the deteriorated state of the photosensitive drum 28 can be determined based on the result of the above detection. According to the present aspect, the toner consumption for detection of the deteriorated state of the photosensitive drum 28 can be suppressed, because toner that can adhere to the unirradiated portion is negligible in amount.

In addition, the deteriorated state of the photosensitive drum 28 is decided by optically measuring the density by the sensor 15, and comparing thereof with the fogging density as a reference value. This allows the measurement to be performed in a simple configuration.

In addition, the sensor 15 plays a double role: conducting the detection of the deteriorated state of the photosensitive drum 28, and conducting the calibration of the image forming property, thereby simplifying the overall configuration.

Moreover, the applied voltage from the charger 29 is varied in a plurality of stages, and the deteriorated state of the photosensitive drum 28 is decided based on the applied voltage in a stage of when the density value of the toner adhered to the photosensitive drum 28 reached the fogging density as a reference value. This allows high-precision determination of the state of deterioration.

And also, since the applied voltage is varied in stages during one rotation of the photosensitive drum 28, a quick detection is possible even when the applied voltage is varied in multistage.

Figure 6:
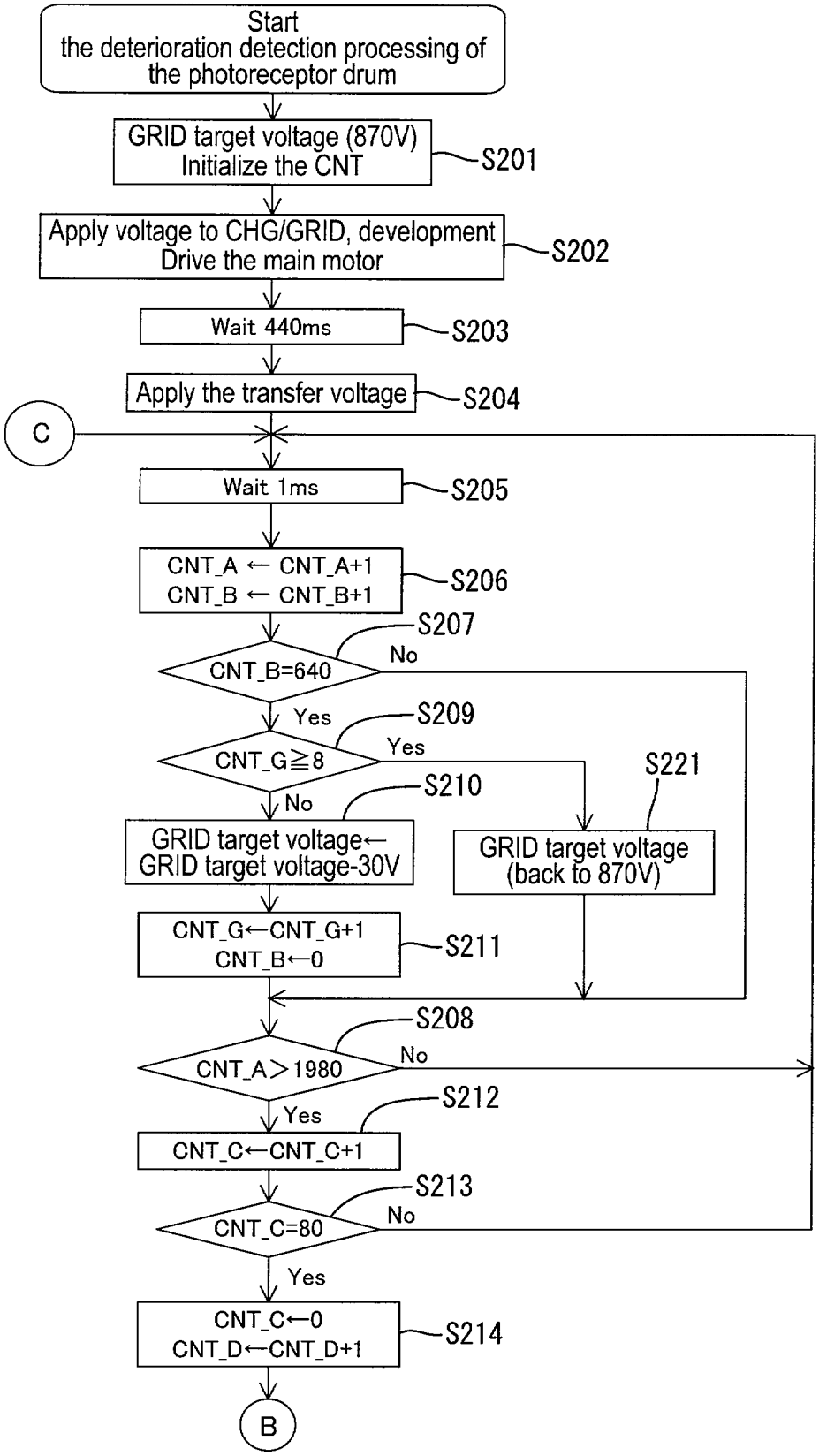
FIG. 6 is a flowchart showing a processing flow of the deterioration detection of a photosensitive drum in accordance with another aspect of the present invention.
Figure 7:
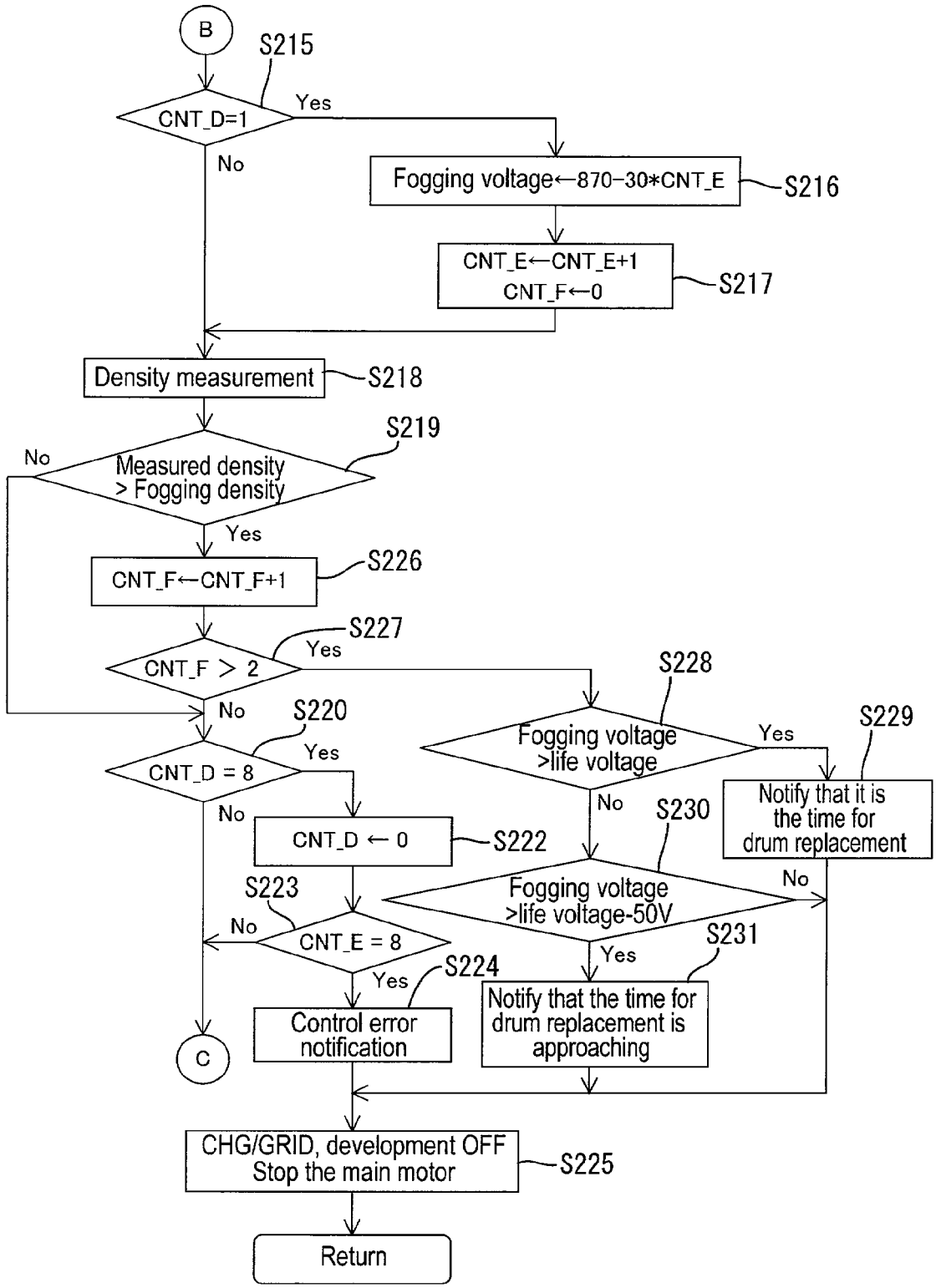
FIG. 7 is a flowchart showing a processing flow of the deterioration detection of a photosensitive drum.

Next, as referring to FIGS. 6 and 7, another aspect of this invention is described. FIGS. 6 and 7 are flowcharts each showing the processing flow of the deterioration detection of the photosensitive drum 28 in accordance with the present aspect; Additionally, in the following aspect, the general configuration of the printer 1 is the same as those in FIGS. 1 and 2, and therefore, a repetitive description is omitted by allocating the same symbols to the same elements.

When the CPU 40 begins to perform the deterioration detection processing, it firstly sets the target voltage of the grid 29B to 870V, and then sets each of the counters to the default value: zero (S201). In this deterioration detection processing, seven counters (CNT_A to CNT_G) are employed.

CNT_A: for counting the time to start the density measurement;

CNT_B: for counting the time for one rotation of the photosensitive drum;

CNT_C: for counting the time of 80 ms;

CNT_D: for counting the number of times of the density measurement;

CNT_E: for counting the number of stage of the grid voltage corresponding to the measuring part;

CNT_F: for counting the number of times of when the measured density surpassed the fogging density;

CNT_G: for counting the number of times of the grid voltage change.

Subsequently, the discharge wire 29A, the grid 29B, and the developing roller 25 are applied with voltage by the high-voltage applying circuit 48, so as to begin the drive of the main motor 47 (S202). And the CPU 40 waits for 440 ms (S203), before applying the transfer voltage to the transferring roller 14 with the high-voltage applying circuit 48 (S204).

The CPU 40 then waits for 1 ms (S205), and the counter CNT_A that counts the time to start the density measurement, as well as the counter CNT_B that counts the time for one rotation of the photosensitive drum are incremented by one (S206). After that, the CPU 40 checks whether the CNT_B indicates '640', more specifically, whether the photosensitive drum 28 finished one rotation (S207), and if the CNT_B does not indicate '640' (S207: No), the CPU 40 then checks whether CNT_A indicates the value greater than '1980'

(S208). The value '1980' corresponds to the waiting time for the virtual toner-adhered part on the belt 13, which is in a position opposed to the part to be measured first in the surface of the photosensitive drum 28 (the part corresponding to the grid voltage 840V), to reach to the position of the sensor 15. This waiting time can vary according to the arrangement position of the photosensitive drum 28.

When the counter CNT_A shows a value not greater than '1980' (S208: No), the processing returns to S205 in order to repeat the same steps. After that, when the counter CNT_B reaches '640' (S207: Yes), more specifically, when the photosensitive drum 28 finished one rotation, the CPU 40 decides whether the counter CNT_G indicates the number of times of grid voltage change '8' or greater (S209). If the counter CNT_G is decided not indicating '8' or greater (S209: No), the target voltage of the grid 29B is lowered for 30V (S210). And then, the counter CNT_G is incremented by one, and the counter CNT_B is set back to zero (S211), so that the processing proceeds to S208. Repeating the above-mentioned processing S205 to S211 allows the target voltage of the grid 29B to decrease for 30V for every rotation of the photosensitive drum 28.

When the value of the counter CNT_A surpasses '1980' (S208: Yes), more specifically, the virtual toner-adhered part on the belt 13 mentioned above reaches the position of the sensor 15, the CPU 40 adds one to the counter CNT_C, that counts the time of 80 ms (more specifically, the time taken for the photosensitive drum 28 to rotate one-eighth of a rotation) (S212). Then, the CPU 40 checks whether the value shown by the counter CNT_C reaches '80' (S213), and if the counter CNT_C does not indicates '80' (S213: No), the CPU 40 returns to S205, and repeats the same processing.

When the value of the counter CNT_C reaches '80' (S213: Yes), more specifically, when the photosensitive drum 28 completed one-eighth of a rotation, the CPU 40 sets the counter CNT_C back to zero, and adds one to the counter CNT_D, that counts the number of times of density measurement (S214), and then checks whether the counter CNT_D indicates one (S215). When the value of the counter CNT_D is one (S215: Yes), the grid voltage of one stage higher than that of the grid voltage corresponding to the virtual toner-adhered part on the belt 13 (its toner density is to be measured next) is calculated by the formula: [870−30*CNT_E]. This figure is the fogging voltage (S216). Next, the CNT_E, which indicates the number of the stage of the grid voltage corresponding to the virtual toner-adhered part to be measured, is incremented by one, and the CNT_F, that counts the number of times of when the measured density surpassed the fogging density, is set to zero (S217).

In S215, the CPU 40 measures the density of the virtual toner-adhered part on the belt 13 with the sensor 15 (S218), when the counter CNT_D does not indicate one (S215: No), or when the processing in S217 is completed. The density value obtained by the measurement is then compared with a predetermined fogging density (S219). When the measured density value is not greater than the fogging density (S219: No), the CPU 40 determines whether the value in the counter CNT_D reaches eight (S220), and if the value in the counter CNT_D does not reach eight (S220: No), the process returns to S205.

After that, every time the value in the counter CNT_C reaches '80' (S213: Yes), more specifically, every time the photosensitive drum 28 rotates for one-eighth, the density measurement is conducted in S218. When the counter CNT_G shows a value greater than eight (S209: Yes), more specifically, when the photosensitive drum 28 has completed one rotation with the grid voltage decreased for eight stages from 840V to 630V, the target voltage of the grid 29B is set to 870V (S221). This ends the grid voltage change.

When the value of the counter CNT_D reaches eight (S220: Yes), more specifically, when eight measurements corresponding to the grid voltage of the present stage are completed, the CPU 40 sets the counter CNT_D back to zero (S222), and then determines whether the value in the counter CNT_E reached eight, more specifically, whether the measurement corresponds to the grid voltage in the eighth stage (S223). If the value in the counter CNT_E does not reach eight (S223: No), the processing returns to S205.

When the value of the counter CNT_E reaches eight (S223: Yes), more specifically, when no fogging is distinguished even if the measurement corresponding to the grid voltage in the eighth stage is completed, the CPU 40 directs the display unit 46 a notification of a control error (S224). After that, the voltage application from the high-voltage applying circuit 48 to the discharge wire 29A, the grid 29B, and the developing roller 25 is turned off, and the drive of the main motor 47 is stopped (S225), so that the deterioration detection processing is ended.

In the density measurement, when the measured density value is greater than the fogging density (S219: Yes), the CPU 40 adds one to the counter CNT_F (S226), and then distinguishes whether the value in the counter CNT_F is greater than two (S227). When the value of the counter CNT_F is not greater than two (S227: No), more specifically, when the number of times, in which the measured density value is distinguished as surpassing the fogging value, is one or two, the processing proceeds to S220.

When the value of the counter CNT_F is greater than two in S227 (S227: Yes), more specifically, when the measured density value is distinguished as surpassing the fogging value for three times in the measurement corresponding to the grid voltage of the present stage, the CPU 40 compares the fogging voltage obtained in S216 with a predetermined life voltage (S228). And if the fogging voltage value is greater than the life voltage value (S228: Yes), a notification is displayed on display unit 46 that it is the time for replacement of the photosensitive drum 28 (S229). Furthermore, when the fogging voltage is less than the life voltage (S228: No), and is greater than the value deducting '50' from the life voltage (S230: Yes), a notification is displayed on display unit 46 that the time for replacement of the photosensitive drum 28 is approaching (S231).

When the fogging voltage is not greater than the value deducting '50' from the life voltage (S230: No), or when S229 and S231 have been performed for the notification, the voltage application from the high-voltage applying circuit 48 to the discharge wire 29A, the grid 29B, and the developing roller 25 is turned off, and the drive of the main motor 47 is stopped, so that the deterioration detection processing is ended.

According to the present aspect, the photosensitive drum 28 is charged at a different applied voltage for every rotation, so that the toner density adhered to the photosensitive drum 28 is detected by the sensor 15. Based on the detection result therefrom, the deteriorated state of the photosensitive drum 28 is able to be determined. Moreover, at one applied voltage (grid voltage), the toner densities in a plurality of parts in the photosensitive drum 28 are detected, so that the deteriorated state of the photosensitive drum 28 is determined base on the detection results therefrom. This allows a high-precision decision even if the adhered state of the toner and the deteriorated state of the photosensitive drum 28 are uneven according to positions on the photosensitive drum 28.

Figure 8:
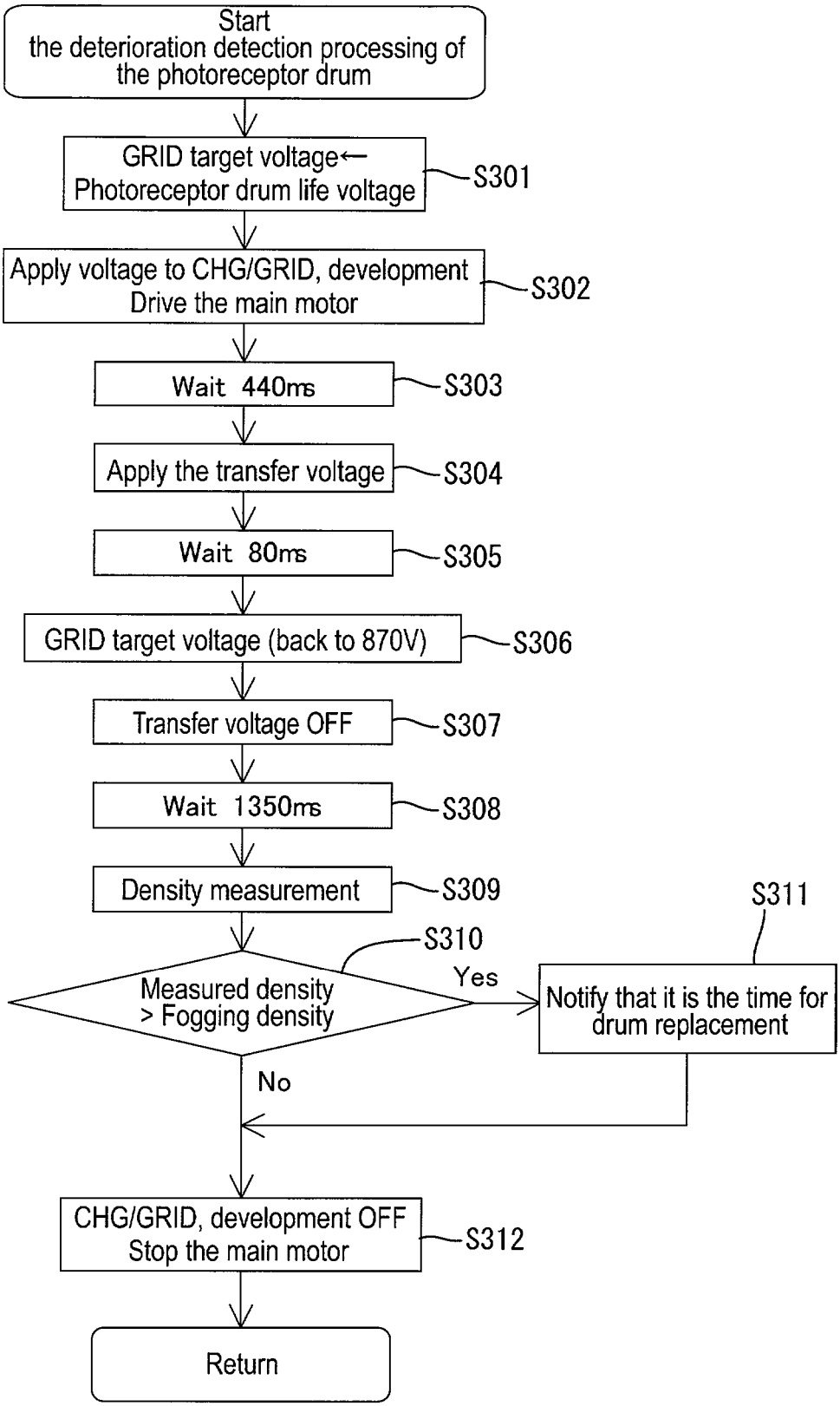
FIG. 8 is a flowchart showing a processing flow of the deterioration detection of a photosensitive drum in accordance with another aspect of the present invention.

Next, as referring to FIG. 8, another aspect of this invention is described. FIG. 8 is a flowchart showing the processing flow of the deterioration detection of the photosensitive drum 28 in accordance with the present aspect.

When the CPU 40 begins to perform the deterioration detection processing, it first sets the target voltage of the grid 29B to the life voltage (S301). This life voltage is a predetermined reference potential, and is less than 870V. Following the above, the discharge wire 29A, the grid 29B, and the developing roller 25 are applied with voltage by the high-voltage applying circuit 48, so as to begin the drive of the main motor 47 (S302). And the CPU 40 waits for 440 ms (S303), before sending a signal to apply the transfer voltage to the transferring roller 14 with the high-voltage applying circuit 48 (S304).

Next, the CPU 40 waits for 80 ms (corresponding to one-eighth rotation of the photosensitive drum 28) (S305), before setting the target voltage of the grid 29B to 870V (S306). This enables a part for one-eighth rotation of the photosensitive drum 28 to be charged by the life voltage.

After that, the transferring voltage to the transferring roller 14 is turned off (S307), and the CPU 40 waits for 1350 ms (S308). This waiting time corresponds to the time for the virtual toner-adhered part on the belt 13 (which is in a position opposed to the part charged by the life voltage in the surface of the photosensitive drum 28), to reach a position of the sensor 15, and the time value varies according to the position of the photosensitive drum 28.

After that, the toner density on the belt 13 is measured by the sensor 15 (S309), and the toner density value obtained thereby is compared with the fogging density value, which is predetermined as a reference for distinguishing the occurrence of fogging (S310). When the measured toner density value is greater than the fogging density value (S310: Yes), more specifically, when the occurrence of the fogging is distinguished, a notification telling it is the time for replacement of the photosensitive drum 28 is displayed on the display unit 46 (S311).

When the measured toner density value is not greater than the fogging density value (S310: No), or, when the notification has been completed in S311, the voltage application from the high-voltage applying circuit 48 to the discharge wire 29A, the grid 29B, and the developing roller 25 is turned off, and the drive of the main motor 47 is stopped (S312), so that the deterioration detection processing is ended.

Since the present aspect performs the detection by employing the applied voltage (grid voltage) of the charger 29 as a single reference potential, a quick decision processing of the deteriorated state is possible, thereby reducing the toner consumption.

Figure 9:
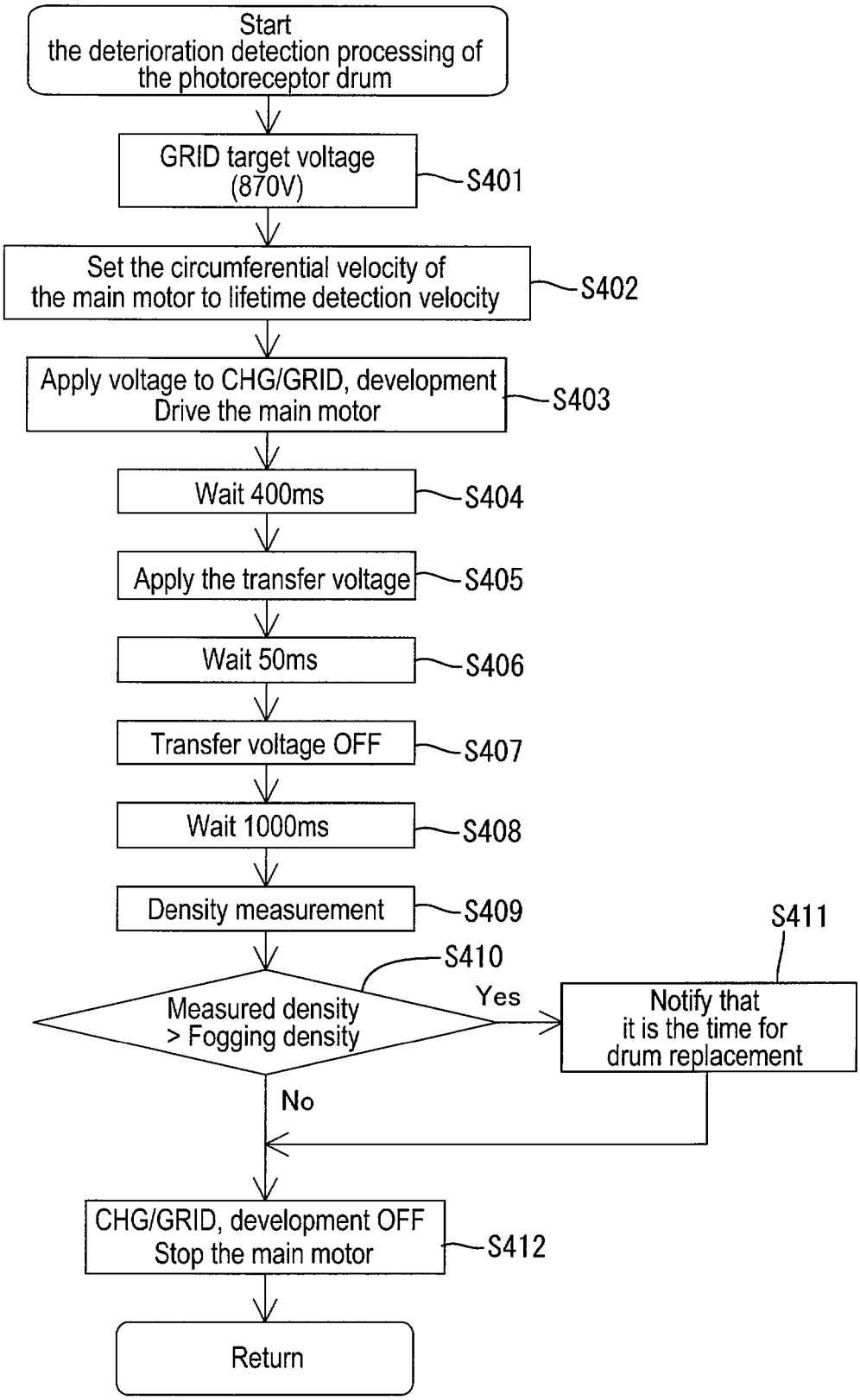
FIG. 9 is a flowchart showing a processing flow of the deterioration detection processing of a photosensitive drum in accordance with another aspect of the present invention.

Next, as referring now to FIG. 9, another aspect of this invention is described. FIG. 9 is a flowchart showing the processing flow of the deterioration detection of the photosensitive drum 28 in accordance with the present aspect.

When the CPU 40 begins to perform the deterioration detection processing, it firstly sets the target voltage of the grid 29B to 870V (S401). Next, the circumferential velocity of the main motor 47 is set to the lifetime detection velocity (S402). This lifetime detection velocity is a predetermined reference-circumferential velocity and is greater than that at the time of image formation. Following the above, the discharge wire 29A, the grid 29B, and the developing roller 25 are applied with voltage by the high-voltage applying circuit 48, so as to begin the drive of the main motor 47 (S403).

And the CPU 40 waits for 400 ms (S404), before applying the transfer voltage to the transferring roller 14 with the high-voltage applying circuit 48 (S405). The CPU 40 waits further for 50 ms (S406), before turning off the application of the transfer voltage to the transferring roller 14 (S407). According to this, a part in the surface of the photosensitive drum 28 is charged by the grid voltage of 870V at a higher-circumferential velocity compared with the normal circumferential velocity.

And then, the CPU 40 waits for 1000 ms (S408). This waiting time corresponds to the time for the virtual toner-adhered part on the belt 13, which is in a position opposed to the part charged by the life voltage in the surface of the photosensitive drum 28, to reach a position of the sensor 15, and the time value varies according to the position of the photosensitive drum 28.

After that, the toner density on the belt 13 is measured by the sensor 15 (S409), and the toner density value obtained is compared with the fogging density value, which is predetermined as a reference for distinguishing the occurrence of fogging (S410). When the measured toner density value is greater than the fogging density value (S410: Yes), more specifically, when the occurrence of the fogging is distinguished, a notification is shown of the display unit 46 that it is the time for replacement of the photosensitive drum 28 (S411).

When the measured toner density value is not greater than the fogging density value (S410: No), or, when the notification has been completed in S411, the voltage application from the high-voltage applying circuit 48 to the discharge wire 29A, the grid 29B, and the developing roller 25 is turned off, and the drive of the main motor 47 is stopped (S412), so that the deterioration detection processing is ended.

As described above, the present aspect enables a determination of the deteriorated state of the photosensitive drum 28 by driving the photosensitive drum 28 at a reference circumferential velocity, that is different from one at the time of image formation, on the basis of the detection result therefrom. Even if the applied voltage of the charger 29 is same, the adhesion state of the toner varies according to the circumferential velocity of the photosensitive drum 28. More specifically, a new photosensitive drum 28 is easily charged even when the circumferential velocity at the time of charging becomes greater to some level, and thus, the fogging may hardly occur: a deteriorated photosensitive drum 28 is difficult to be sufficiently charged when the circumferential velocity at the time of charging becomes greater, and thus, the fogging may occur. This allows a determination of the deteriorated state based on the density of the toner adhered to the photosensitive drum 28 when the photosensitive drum 28 is set to the reference circumferential velocity. Since the reference circumferential velocity is greater than that at the time of image formation, a quick deterioration detection processing is possible.

In the above aspect, one example, in which the present invention is applied to a direct tandem printer, has been described, however, the present invention may also be applied to a image forming apparatus of other systems, such as the intermediate transfer system, the four-cycle electrophotographic system, and furthermore, a monochrome image forming apparatus. In the above aspect, the density of the toner, which has been transferred onto a belt from a photosensitive drum, is measured, however, according to the present invention, for example, an optical detection unit may be provided around an image carrier, so that the amount of the developer which has been adhered to the image carrier is directly measured.

The voltage and the polarity applied to each unit in the above aspect may be appropriately changed, and, for example, the developer may be charged negatively.

In the above aspect, the density measurement of a developer is conducted by varying an applied voltage of a charger from the time of the image formation, however, according to the present invention, the voltage to a developing unit may be varied if the potential difference between the developing unit and the surface of an image carrier is smaller than that at the time of image formation, or, the potential in both sides of the charger and the developing unit may be varied.

What is claimed is:

1. An image forming apparatus comprising:

an image carrier configured to support an electrostatic latent image;

a charger configured to charge the image carrier to an electrical potential according to an applied voltage;

an exposure unit configured to form the electrostatic latent image by exposing the image carrier;

a developing unit configured to develop the electrostatic latent image into a developer image by adhering a developer to the image carrier;

a belt;

a transferring unit configured to transfer the developer image from the image carrier to the belt;

a detection unit configured to detect a density of a developer adherent to the belt; and a controller configured to:

determine a deteriorated state of the image carrier by charging a portion of the image carrier, subsequently subject the portion of the image carrier to a development using the developing unit without subjecting the portion of the image carrier to exposure by the exposure unit, in a condition where a potential difference between the charger and the developing unit is set to be smaller than that at a time of image formation, transfer the developer on the portion of the image carrier to the belt by the transferring unit, and detect, with the detection unit, the density of the developer transferred to the belt.

2. An image forming apparatus according to claim 1, wherein the detection unit optically detects the density of the developer on the belt, and the controller determines the deteriorated state of the image carrier by comparing a density value detected by the detection unit with a reference value.

3. An image forming apparatus according to claim 1, further comprising:

a plurality of image carriers; and a correction unit configured to correct an image formation property based on a detection result obtained by the detection unit, wherein the detection unit is configured to optically detect a developer adhesion pattern that has been transferred from the plurality of image carriers onto the belt.

4. An image forming apparatus according to claim 1, wherein the controller is configured to:

vary an applied voltage of the charger in a plurality of stages; and determine the deteriorated state of the image carrier based on the applied voltage.

5. An image forming apparatus according to claim 4, wherein the controller is configured to charge the image carrier for every rotation at a different applied voltage with the charger, and to detect, with the detection unit, the density of the developer on the belt transferred from the image carrier for every rotation, so that the deteriorated state of the image carrier based on a detection result is determined.

6. An image forming apparatus according to claim 1, wherein the controller is configured to detect, with the detection unit, densities of developer on the belt transferred from a plurality of parts on the image carrier corresponding to one applied voltage of the charger, and to determine the deteriorated state of the image carrier based on a detection result therefrom.

7. An image forming apparatus according to claim 1, wherein the controller is configured to vary an applied voltage of the charger in a plurality of stages during one rotation of the image carrier, and to detect, with the detection unit, a density of a portion of the developer on the belt transferred from a part on the image carrier corresponding to applied voltages in each of the stages, wherein the deteriorated state of the image carrier is determined based on detection results therefrom.

8. An image forming apparatus according to claim 1, wherein the controller is configured to identify an applied voltage of the charger as a single reference potential, and to detect, with the detection unit, only a density of a portion of the developer on the belt transferred from a part on the image carrier corresponding to the applied voltage, wherein the deteriorated state of the image carrier is determined based on detection results therefrom.

9. An image forming apparatus according to claim 1, wherein the controller is configured to drive the image carrier at a reference circumferential velocity different from a circumferential velocity at the time of image formation, and to detect, with the detection unit, the density of the developer on the belt transferred from the image carrier, wherein the deteriorated state of the image carrier is determined based on the detection result therefrom.

* * * * *